US008552970B2

(12) United States Patent
Yamashita

(10) Patent No.: US 8,552,970 B2
(45) Date of Patent: Oct. 8, 2013

(54) LIQUID CRYSTAL DISPLAY DEVICE

(75) Inventor: Hiroshi Yamashita, Osaka (JP)

(73) Assignee: Funai Electric Co., Ltd., Osaka (JP)

( * ) Notice: Subject to any disclaimer, the term of this patent is extended or adjusted under 35 U.S.C. 154(b) by 810 days.

(21) Appl. No.: 12/721,152

(22) Filed: Mar. 10, 2010

(65) Prior Publication Data

US 2010/0231578 A1 Sep. 16, 2010

(30) Foreign Application Priority Data

Mar. 11, 2009 (JP) ..... P.2009-057364

(51) Int. Cl.
*G09G 3/36* (2006.01)

(52) U.S. Cl.
USPC ..... 345/102; 345/82; 345/76; 315/192; 315/193; 349/65; 362/608; 362/612; 362/97.2; 362/97.3

(58) Field of Classification Search
USPC ..... 345/102, 213, 204, 87, 39, 44, 46, 82, 345/83, 76; 362/276, 27, 237, 600, 362/608–629, 97.1–97.4; 315/192, 193; 349/61–64, 69–70
See application file for complete search history.

(56) References Cited

U.S. PATENT DOCUMENTS

| | | | | |
|---|---|---|---|---|
| 8,188,679 | B2 * | 5/2012 | Hoogzaad | 315/294 |
| 2002/0008694 | A1 * | 1/2002 | Miyachi et al. | 345/204 |
| 2003/0107538 | A1 * | 6/2003 | Asao et al. | 345/87 |
| 2006/0119566 | A1 * | 6/2006 | Sato et al. | 345/102 |
| 2006/0202914 | A1 * | 9/2006 | Ashdown | 345/46 |
| 2006/0226800 | A1 | 10/2006 | Bruning | 318/280 |
| 2006/0232544 | A1 | 10/2006 | Sakashita | 345/102 |
| 2007/0103905 | A1 * | 5/2007 | Kang et al. | 362/276 |
| 2007/0262948 | A1 * | 11/2007 | Han et al. | 345/102 |
| 2010/0194274 | A1 * | 8/2010 | Hoogzaad | 315/51 |
| 2010/0315016 | A1 * | 12/2010 | Hoogzaad | 315/224 |
| 2011/0068702 | A1 * | 3/2011 | van de Ven et al. | 315/186 |

FOREIGN PATENT DOCUMENTS

| | | |
|---|---|---|
| EP | 1 898 676 A1 | 3/2008 |
| JP | 2005-302712 | 10/2005 |
| WO | WO 2009/013675 | 1/2009 |

* cited by examiner

*Primary Examiner* — Lun-Yi Lao
*Assistant Examiner* — Priyank Shah
(74) *Attorney, Agent, or Firm* — Morgan, Lewis & Bockius LLP

(57) ABSTRACT

A liquid crystal display device is provided. A plurality of light emitting units includes a plurality of light emitting elements which are configured to emit light toward a liquid crystal panel through a light guide plate. The light emitting units are arranged in series at an interval in such a direction that the light emitting elements face a side surface of the light guide plate. A feeding circuit is configured to supply power to the light emitting units. A first switch is connected to both ends of at least one of the light emitting units such that the at least one of the light emitting units connected between the both ends is deactivated when the first switch is turned on. A second switch is connected to both ends of at least one of the light emitting units such that the at least one of the light emitting units connected between the both ends is deactivated when the second switch is turned on. A switching unit is configured to control an on/off state of each of the first and second switches according to a driving timing of the liquid crystal panel to subsequently switch the light emitting units to be deactivated.

2 Claims, 5 Drawing Sheets

LIQUID CRYSTAL DISPLAY DEVICE

The disclosure of Japanese Patent Application No. 2009-057364 filed on Mar. 11, 2009 including specification, drawings and claims is incorporated herein by reference in its entirety.

BACKGROUND

The present invention relates to a liquid crystal display device.

In a related-art liquid crystal display device such as liquid crystal television, a light guide plate is disposed behind a liquid crystal panel, a plurality of light emitting elements such as LEDs are provided around the light guide plate as a light source, and light emitted from the light source is used as backlight that is incident on the liquid crystal panel through the light guide plate. When all of the light emitting elements disposed in the light source are turned on all the time, image blur (image sticking) occurs in a display screen. Accordingly, the driving timing of the liquid crystal panel is adjusted to turn off the light emitting elements each time an image signal of one frame is input to the liquid crystal display device, thereby displaying a black screen. This signal processing is called black insertion driving process. In the black insertion driving process, the amount of current or voltage applied to each light emitting element is sequentially controlled to switch the light emitting elements to be turned on or off, as required.

However, the above process that sequentially controls the amount of current or the voltage applied to each light emitting element is not efficient because a large process load is applied to a control unit such as a CPU.

Therefore, for example, Japanese Patent Publication No. 2005-302712 A discloses an LED driving circuit which includes a series-parallel circuit in which a plurality of parallel circuit blanches which are connected in series to each other and each of the parallel circuit blanches includes one or more LEDs (light emitting elements) and at least one switches which are connected in series to each other.

According to the LED driving circuit disclosed in Japanese Patent Publication No. 2005-302712 A, a plurality of series circuits in which LEDs for each color and switches are connected in series to each other are connected in parallel to each other. Therefore, when an arbitrary switch is turned on, a potential difference occurs only in the LED for an arbitrary color, connected to the switch to turn on the LED. Accordingly, it is possible to prevent a variation in the display color or the brightness of light emitted from the LED on the display screen.

In the liquid crystal display device including the LED driving circuit disclosed in Japanese Patent Publication No. 2005-302712 A, it is possible to easily prevent the variation in the display color or the brightness of light on the display screen without sequentially controlling the amount of current or voltage applied to each light emitting element. Japanese Patent Publication No. 2005-302712 A, however, does not disclose a detailed method of switching the light emitting elements to be turned on or off according to the driving timing of the liquid crystal panel in, for example, the black insertion driving process.

SUMMARY

It is therefore an object of at least one embodiment of the present invention to provide a liquid crystal display device capable of easily switching light emitting elements to be turned on or off according to the driving timing of a liquid crystal panel.

In order to achieve the above described object, according to a first aspect of at least one embodiment of the present invention, there is provided a liquid crystal display device, comprising: a liquid crystal panel on which an image based on a video signal is displayed; a light guide plate disposed behind the liquid crystal panel; a plurality of light emitting units including a plurality of light emitting elements configured to emit light toward the liquid crystal panel through the light guide plate, the light emitting units arranged in series at an interval in such a direction that the light emitting elements face a side surface of the light guide plate; a feeding circuit configured to supply power to the light emitting units, the feeding circuit including: a first switch which is connected to both ends of at least one of the light emitting units, wherein the at least one of the light emitting units connected between the both ends is deactivated when the first switch is turned on; and a second switch which is connected to both ends of at least one of the light emitting units, wherein the at least one of the light emitting units connected between the both ends is deactivated when the second switch is turned on; and a switching unit configured to control an on/off state of each of the first and second switches according to a driving timing of the liquid crystal panel to subsequently switch the light emitting units to be deactivated.

The liquid crystal display device may further comprise a changing unit configured to change an order in which the switching unit switches the light emitting units to be deactivated.

Each of the light emitting units may include a plurality of light emitting elements arranged in series, in parallel, or in series-parallel combination.

According to a second aspect of at least one embodiment of the present invention, there is provided a liquid crystal display device, comprising: a liquid crystal panel on which an image based on a video signal is displayed; a light guide plate disposed behind the liquid crystal panel; a first light emitting unit including a plurality of light emitting elements configured to emit light toward the liquid crystal panel through the light guide plate, a second light emitting unit including a plurality of light emitting elements configured to emit light toward the liquid crystal panel through the light guide plate, wherein the first and second light emitting units arranged in series along a side surface of the light guide plate; a feeding circuit configured to supply power to the first and second light emitting units, the feeding circuit including: a first switch which is connected to both ends of the first light emitting unit, wherein the first light emitting unit is deactivated when the first switch is turned on; and a second switch which is connected to both ends of the second light emitting unit, wherein the second light emitting unit is deactivated when the second switch is turned on; a switching unit configured to control an on/off state of each of the first and second switches according to a driving timing of the liquid crystal panel to subsequently switch the first and second light emitting units to be deactivated; and a changing unit configured to change an order in which the switching unit switches the first and second light emitting units to be deactivated; wherein the light emitting elements included in each of the first and second light emitting units are arranged in series, in parallel, or in series-parallel combination.

According to the above-mentioned aspects of the invention, the light emitting units including the light emitting elements are arranged in series. When the first switch connected to both ends of at least one of the light emitting units are turned on, the at least one of light emitting units is deactivated. When the second switch connected to both ends of at least one of the light emitting units are turned on, the at least one of light emitting units is deactivated. Therefore, it is possible to easily switch the light emitting elements to be activated or deactivated only by turning on or off the first and second switches, without sequentially controlling the amount of current or voltage applied to each of the light emitting elements. In addition, it is possible to sequentially switch one or more light emitting units to be deactivated by controlling the on/off state of each of the first and second switches according to the driving timing of the liquid crystal panel using the switching unit.

That is, the invention provides a liquid crystal display device capable of easily switching the light emitting elements to be turned on or off according to the driving timing of a liquid crystal panel.

BRIEF DESCRIPTION OF THE DRAWINGS

The above objects and advantages of the present invention will become more apparent by describing in detail preferred exemplary embodiments thereof with reference to the accompanying drawings, wherein:

FIG. 3A illustrates a pattern in which the LEDs are arranged in series, FIG. 3B illustrates a pattern in which the LEDs are arranged in parallel, and FIG. 3C illustrates a pattern in which the LEDs are arranged in series-parallel combination;

DETAILED DESCRIPTION OF THE EMBODIMENTS

Figure 2:
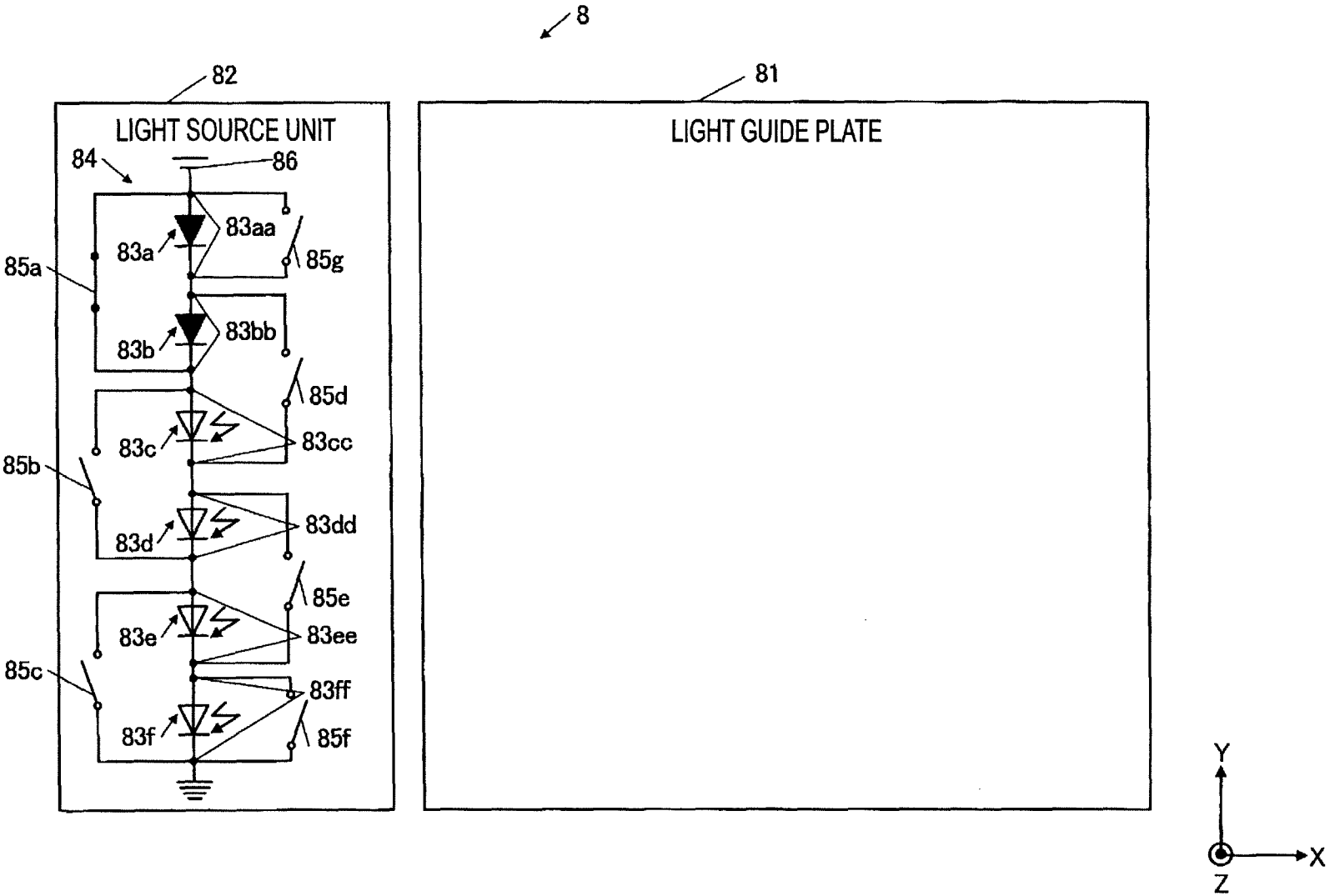
FIG. 2 is a schematic diagram illustrating a positional relationship between a light guide plate and a light source unit and a circuit arrangement of the light source unit according to the embodiment.

Hereinafter, exemplary embodiments of the invention will be described with reference to the accompanying drawings. In the following description, the left-right direction of a light guide plate 81 shown in FIG. 2 is referred to as an X direction, the front-rear direction thereof is referred to as a Y direction, and a direction orthogonal to the X and Y directions is referred to as a Z direction.

Figure 1:
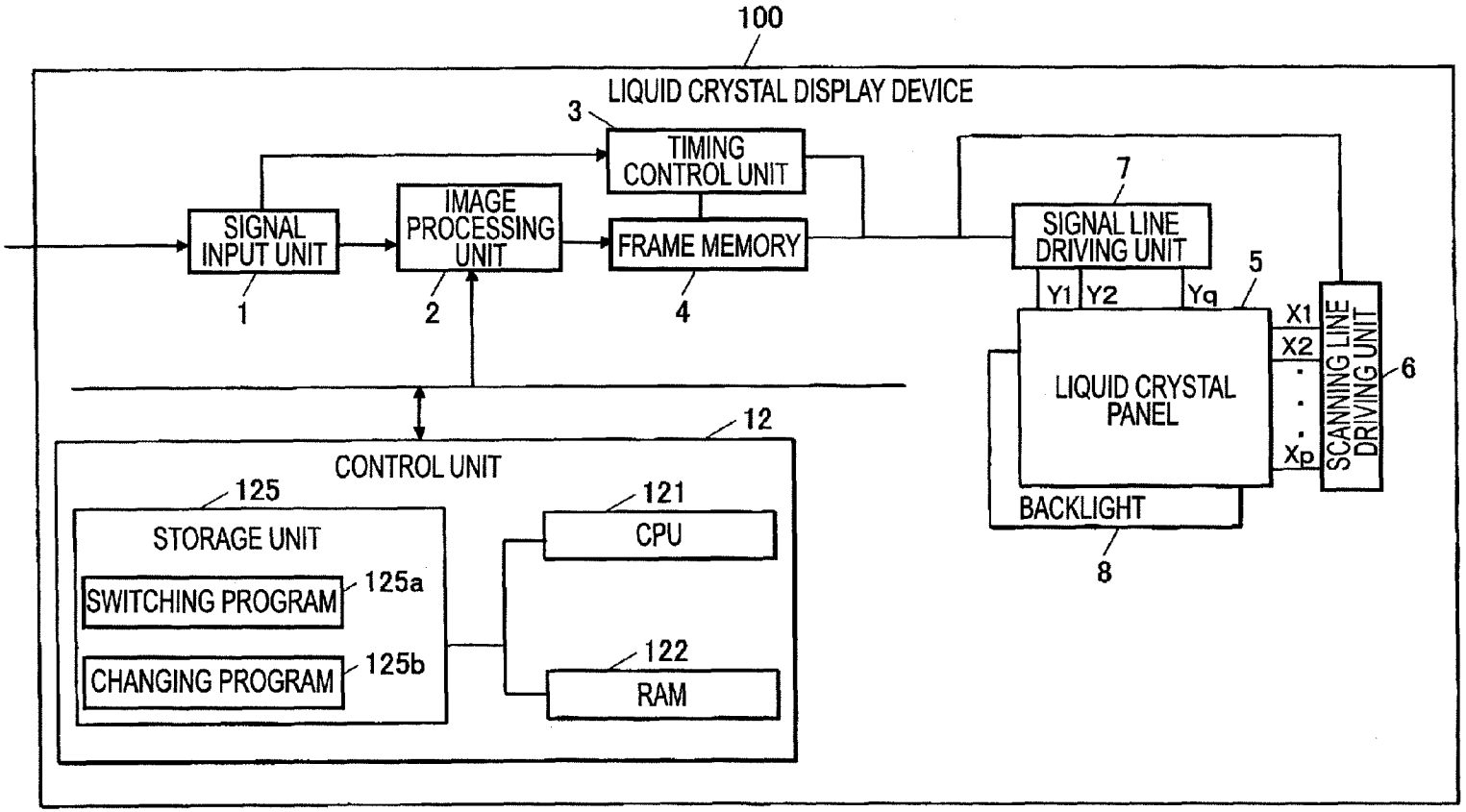
FIG. 1 is a block diagram illustrating a structure of a liquid crystal display device according to an embodiment of the present invention.

As shown in FIG. 1, a liquid crystal display device 100 according to an embodiment of the invention includes, for example, a signal input unit 1, an image processing unit 2, a timing control unit 3, a frame memory 4, a liquid crystal panel 5, a scanning line driving unit 6, a signal line driving unit 7, a backlight 8, and a control unit 12.

The signal input unit 1 includes, for example, an antenna that receives television broadcasting signals, a tuner, and various kinds of video terminals through which video signals are received from an external apparatus. The signal input unit 1 receives the input video signal and outputs it to the image processing unit 2.

The image processing unit 2 includes, for example, an A/D conversion circuit, an RGB generating circuit, and an image quality adjusting circuit. The image processing unit 2 generates RGB digital video signals on the basis of the video signals supplied from the signal input unit 1 and performs a scaling process corresponding to the number of pixels of the liquid crystal panel 5 to generate video signals corresponding to one frame. In addition, the image processing unit 2 performs various kinds of image quality adjusting processes, such as brightness, contrast, color density, color shade, and sharpness adjusting processes, on the video signals corresponding to one frame on the basis of the image quality adjustment signals output from the control unit 12, and outputs the processed signals to the frame memory 4.

The timing control unit 3 generates a timing signal indicating one line period (a horizontal synchronization signal) and a timing signal indicating one frame period (a vertical synchronization signal) on the basis of the video signal supplied from the signal input unit 1 and supplies the timing signals to each unit of the liquid crystal display device 100.

The frame memory 4 stores each frame of video signals input from the image processing unit 2 and outputs the video signals to a liquid crystal display (not shown).

The liquid crystal panel 5 includes a pair of substrates separated from each other with a predetermined gap therebetween and liquid crystal that is sealed in a matrix between the pair of substrates. The pair of substrates is interposed between two polarizing plates having polarization axes orthogonal to each other, and the backlight 8 is provided on the rear side of the liquid crystal panel. The display region of the liquid crystal panel 5 is equally divided into a plurality of sub display regions in a matrix by a predetermined dividing method. For example, the display region is divided into n×m sub display regions.

In addition, p scanning lines X (X1 to Xp) and q signal lines Y (Y1 to Yq) are arranged on the upper surface of the substrate so as to be orthogonal to each other. The liquid crystal panel 5 is, for example, an active matrix driving type in which thin film transistors (TFTs), serving as active elements, are provided at intersections of the scanning lines X and the signal lines Y. A pixel electrode is formed in each pixel, and an opposite electrode is formed on an opposite substrate so as to be opposite to the pixel electrode. In addition, alignment films are formed on the surface of the pixel electrode and the surface of the opposite electrode that are opposite to each other. That is, in the liquid crystal panel 5, the TFTs are turned on or off by the timing signal generated by the timing control unit 3 such that charge is stored in the pixel electrodes, and the arrangement direction of the liquid crystal is changed. In this way, the video signal input from the signal input unit 1 is written.

The scanning line driving unit 6 is provided so as to correspond to each of the scanning lines X (X1 to Xp) of the liquid crystal panel 5. The scanning line driving unit 6 sequentially selects the scanning lines X according to the timing signal from the timing control unit 3 and turns on or off the TFTs arranged on the same scanning line X.

The signal line driving unit 7 is provided so as to correspond to each of the signal lines Y (Y1 to Yq) of the liquid crystal panel 5. The signal line driving unit 7 applies the video signal output from the frame memory 4 or a voltage corresponding to a black image to the signal lines Y in synchronization with the scanning of each of the scanning lines X by the scanning line driving unit 6.

Therefore, when the scanning line driving unit 6 and the signal line driving unit 7 respectively drive the scanning lines X and the signal lines Y, the TFTs of the pixels arranged at the intersections of the scanning lines and the signal lines are turned on and charge is stored in the pixel electrodes. Then, the arrangement direction of the liquid crystal interposed between the pixel electrodes and the opposite electrode is changed, thereby transmitting or shielding light emitted from the backlight 8 that is provided on the rear side of the liquid crystal panel 5, in each pixel together with the alignment film and the polarizing film.

The backlight 8 is provided on the rear side of the liquid crystal panel 5 and includes, for example, the light guide plate 81 and a light source unit 82 that is provided on a left surface (in the X direction) of the light guide plate 81, as shown in FIG. 2. The backlight 8 is configured such that light emitted from the light source unit 82 in the X direction is incident on a side surface (YZ surface) of the light guide plate 81 and is reflected to the rear surface of the liquid crystal panel 5 in the Z direction by the light guide plate 81.

Although not shown in the drawings, the light guide plate 81 includes a substrate that is made of, for example, an acrylic material for introducing and transmitting light, reflection dots that are formed on the rear surface (XY surface) of the substrate to reflect light passing through the substrate, a reflection sheet that covers the rear surface of the substrate, is made of a material with high light reflectance, and increases the efficiency of reflection by the reflection dots, and a diffusion sheet that covers the front surface of the substrate and diffuses light emitted from the surface of the substrate by the reflection dots. Therefore, in the light guide plate 81, light emitted from the light source unit 82 in the X direction is introduced into the substrate through the side surface (YZ surface), and light traveling through the substrate is reflected to the front surface of the substrate in the Z direction by the reflection dots (and the reflection sheet). Then, the light is diffused by the diffusion sheet and the diffused light is incident on the rear surface of the liquid crystal panel 5.

The light source unit 82 includes, for example, light emitting units 83*a* to 83*f* and a feeding circuit 84 and has circuit arrangement shown in FIG. 2.

Each of the light emitting units 83*a* to 83*f* includes an LED (Light-Emitting Diode) as a light emitting element that emits light to the liquid crystal panel 5 through the light guide plate 81. The LEDs are arranged at a predetermined interval so as to face the side surface (YZ surface) of the light guide plate 81. Each of the light emitting units 83*a* to 83*f* illuminates a region corresponding to several lines when the liquid crystal panel 5 performs an operation of writing the video signals.

In FIG. 2, each of the light emitting units 83*a* to 83*f* has a single LED between both ends 83*aa* to 83*ff*. However, each of the light emitting units 83*a* to 83*f* may have a plurality of LEDs therebetween.

Figure 3A:
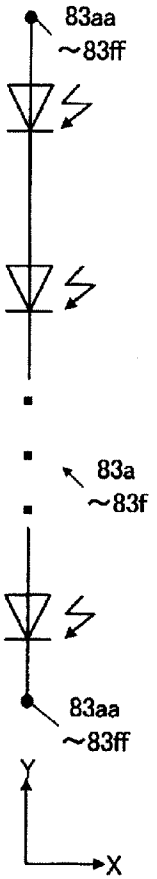
FIGS. 3A to 3C are schematic diagrams illustrating arrangement patterns of LEDs in one of light emitting units according to the embodiment.
Figure 3B:
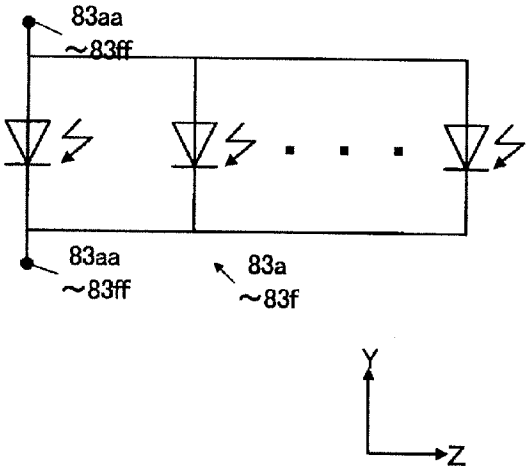
Figure 3C:
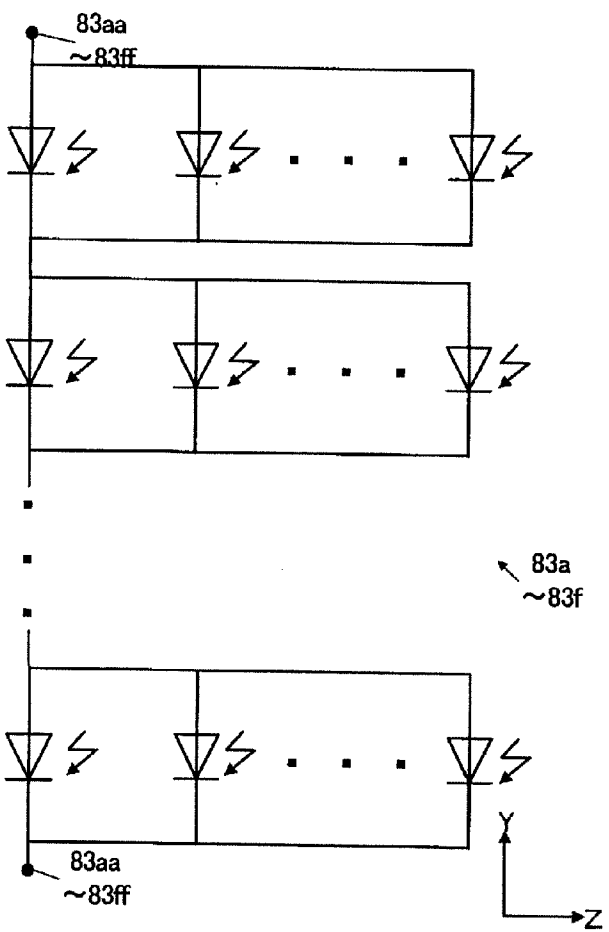

That is, for example, as shown in FIG. 3A, each of the light emitting units 83*a* to 83*f* may include a plurality of LEDs connected in series to each other between both ends 83*aa* to 83*ff*. As shown in FIG. 3B, each of the light emitting units 83*a* to 83*f* may include a plurality of LEDs connected in parallel to each other between both ends 83*aa* to 83*ff* in the thickness direction (Z direction) of the light guide plate 81. As shown in FIG. 3C, each of the light emitting units 83*a* to 83*f* may include a plurality of LEDs connected in series-parallel to each other between both ends 83*aa* to 83*ff*. Therefore, for example, when the amount of light emitted from the backlight to the liquid crystal panel 5 is insufficient or when it is necessary to increase the life span of each LED arranged in the light emitting units 83*a* to 83*f*, it is possible to arrange the plurality of LEDs in series, in parallel, or in series-parallel to each other according to the circumstances.

The feeding circuit 84 is configured to supply power to the light emitting units 83*a* to 83*f* so that the LEDs emit light. The feeding circuit 84 includes, for example, switches 85*a* to 85*g* that are turned on or off in response to an operation signal from the control unit 12 and a power supply 86 that supplies a predetermined voltage to the light emitting units 83*a* to 83*f*. The light emitting units 83*a* to 83*f* are connected in series to each other, and the switches 85*a* to 85*g* are connected to both ends 83*aa* to 83*ff* of each of the light emitting units 83*a* to 83*f*.

When each of the switches 85*a* to 85*g* is turned off, power is supplied to the light emitting units connected between both ends 83*aa* to 83*ff* by the voltage applied by the power supply 86. When each of the switches 85*a* to 85*g* is turned on, the supply of power to the light emitting units connected between both ends 83*aa* to 83*ff* stops. That is, for example, when the switch 85*a* connected between both ends 83*aa* of the light emitting unit 83*a* and both ends 83*bb* of the light emitting unit 83*b* is turned on, a bypass is formed by the switch 85*a* even though the power supply 86 applies a voltage, and there is no potential difference between the light emitting unit 83*a* and the light emitting unit 83*b* (the supply of power stops). Therefore, it is possible to turn off the LEDs included in the light emitting unit 83*a* and the light emitting unit 83*b*.

In FIG. 2, the diodes represented in black in the light emitting unit 83*a* and the light emitting unit 83*b* indicate that the switches 85*a* is turned on and the supply of power to the light emitting unit 83*a* and the light emitting unit 83*b* stops (deactivated). The diodes represented in white in the light emitting units 83*c* to 83*f* indicate that the switches 85*b* to 85*f* are tuned off and the supply of power to the light emitting units 83*c* to 83*f* is maintained (activated).

The control unit 12 includes, for example, a CPU (Central Processing Unit) 121, a RAM (Random Access Memory) 122 that is used as a work area of the CPU 121, and a storage unit 125 that stores various kinds of programs executed by the CPU 121.

The CPU 121 executes various kinds of programs stored in the storage unit 125 according to the input signal input from each unit of the liquid crystal display device 100, and outputs an output signal to each unit on the basis of the executed programs, thereby controlling the overall operation of the liquid crystal display device 100.

The RAM 122 includes, for example, a program storage area for expanding process programs executed by the CPU 121 and a data storage area for storing the input data or the process results of the process programs.

The storage unit 125 has, for example, a switching program 125*a* and a changing program 125*b* stored in a program storage area.

For example, the switching program 125*a* allows the CPU 121 to control the on/off states of each of the switches 85*a* to 85*g* according to the driving timing of the liquid crystal panel 5, thereby sequentially switching one or a plurality of light emitting units 83*a* to 83*f* to be turned off. The driving timing of the liquid crystal panel 5 means, for example, the timing when the video signal is written on the basis of the timing signal generated by the timing control unit 3.

Specifically, the CPU 121 executes the switching program 125*a* to stop the supply of power to a light emitting unit corresponding to a line on which a write operation is performed or the light emitting units adjacent thereto when the liquid crystal panel 5 writes the video signal on the basis of the timing signal generated by the timing control unit 3.

That is, the CPU 121 executes the switching program 125*a* to sequentially turn on the switches 85*a*, 85*b*, and 85*c* at a predetermined time interval in synchronization with the driving of the liquid crystal arranged in the liquid crystal panel 5, thereby sequentially switching the light emitting units 83*a* and 83*b*, the light emitting units 83*c* and 83*d*, the light emitting units 83*e* and 83*f*, and the light emitting units to be turned off (LEDs to be turned off). Therefore, it is possible to obtain a so-called black insertion driving effect (it is possible to prevent image blur on the display screen).

In addition, the CPU 121 executes the switching program 125*a* to control only the on/off states of the switches 85*a* to 85*g* according to the driving timing of the liquid crystal panel 5, without controlling the amount of current or a voltage applied to each of the light emitting units 83*a* to 83*f*, thereby sequentially switching the light emitting units to be turned off (LEDs to be turned off). Therefore, a process load is significantly reduced.

The order in which the light emitting units 83*a* to 83*f* to be turned off are switched is changed by the execution of the changing program 125*b*, which will be described below. The switching program 125*a* sequentially switches the light emitting units 83*a* to 83*f* in the changed order.

For example, the changing program 125*b* allows the CPU 121 to change the order in which the light emitting units to be turned off are switched by the execution of the switching program 125*a*.

Specifically, for example, when the switching program 125*a* is executed and the switches 85*a*, 85*b*, and 85*c* are turned on in this order, the CPU 121 executes the changing program 125*b* to change the order in which the switches are turned on such that the switch 85*d*, the switch 85*e*, the switch 85*f*, and the switch 85*g* (the switch 85*f* and the switch 85*g* are turned on at the same time) are turned on in this order at the next driving timing of the liquid crystal panel 5 (that is, at the timing when the image signals of the next frame are displayed). In this way, the light emitting units 83*b* and 83*c*, the light emitting units 83*d* and 83*e*, the light emitting units 83*f* and 83*a* are tuned off (deactivated) in this order. That is, it is possible to change the order in which the light emitting units to be deactivated are switched. In addition, when the liquid crystal panel 5 writes the image signals, the order of the lines to which the write operation is performed is also changed according to the order in which the light emitting units are switched.

That is, when the light emitting units to be turned off are switched in the same order at each driving timing of the liquid crystal panel 5, the user is likely to perceive a variation in brightness on the display screen during switching. Therefore, as described above, the order in which the light emitting units are switched is changed according to the driving timing. In this way, it is possible to prevent the user from perceiving the variation in brightness.

The switching program 125*a* and the changing program 125*b* are not limited to the above-mentioned configuration in which they allow the CPU to stop the supply of power to a plurality of light emitting units through one switch.

Figure 4:
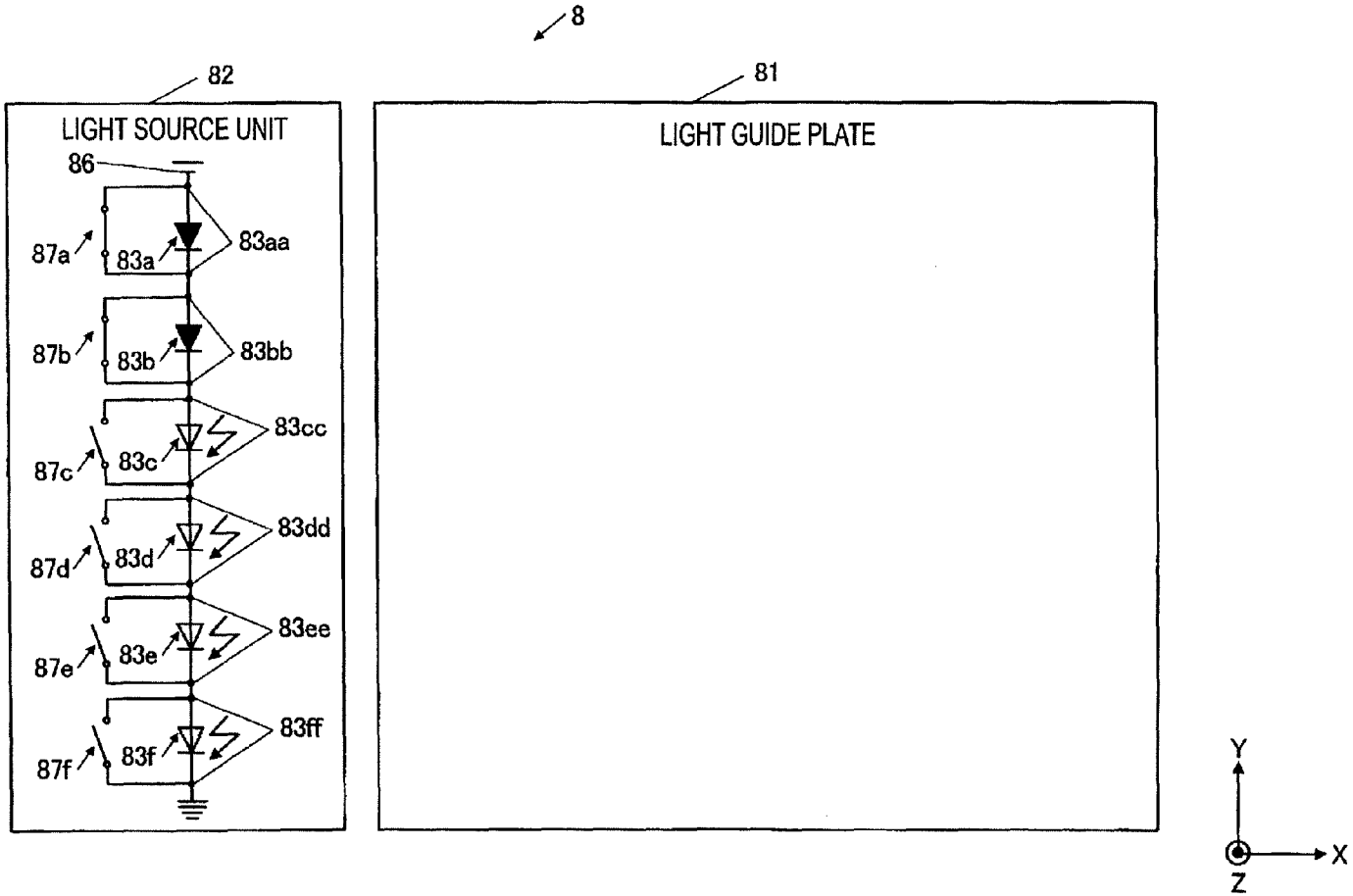
FIG. 4 is a schematic diagram illustrating a positional relationship between the light guide plate and the light source unit and a circuit arrangement of the light source unit according to another embodiment of the present invention.

Specifically, for example, as shown in FIG. 4, switches 87*a* to switch 87*f* may be connected to both ends 83*aa* to 83*ff* of each of the light emitting units 83*a* to 83*f* and the supply of power to the light emitting units 83*a* to 83*f* may be individually switched by the switches 87*a* to 87*f*.

In this case, the CPU 121 executes the switching program 125*a* to sequentially turn on the switches 87*a* and 87*b*, the switches 87*c* and 87*d*, and the switches 87*e* and 87*f* at a predetermined time interval according to the driving timing of the liquid crystal panel 5, thereby sequentially switching the light emitting units 83*a* and 83*b*, the light emitting units 83*c* and 83*d*, the light emitting units 83*e* and 83*f* (switching the light emitting units to be turned off (deactivated)).

In addition, the CPU 121 executes the changing program 125*b* to change the order in which the switches are turned on such that the switches 87*b* and 87*c*, the switches 87*d* and 87*e*, and the switches 87*f* and 87*a* are turned on in this order at the next driving timing of the changing liquid crystal panel 5. In this way, it is possible to change the order in which the light emitting units 83*b* and 83*c*, the light emitting units 83*d* and 83*e*, the light emitting units 83*f* and 83*a*, and the light emitting units to be turned off are switched.

Figure 5:
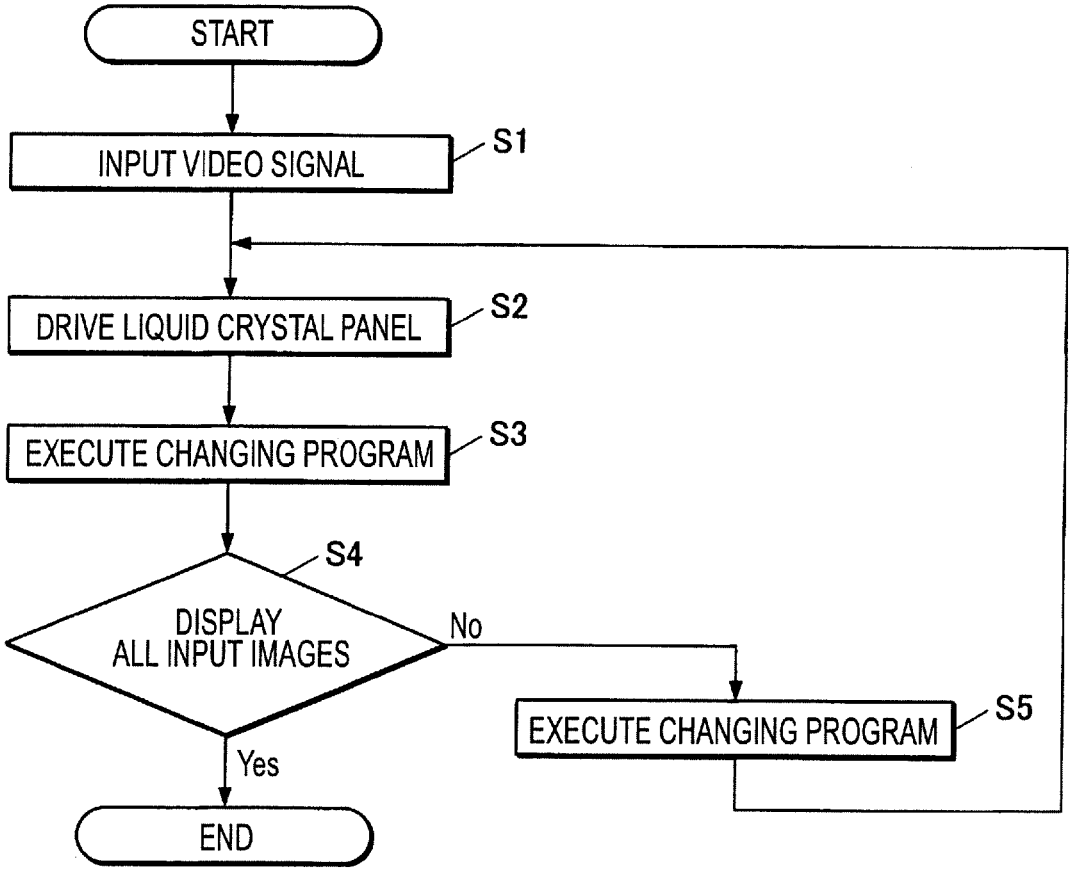
FIG. 5 is a flowchart illustrating a process of switching the light emitting units in the liquid crystal display device according to the embodiment.

Next, the procedure of the switching process of the light emitting units 83*a* to 83*f* in the liquid crystal display device 100 according to this embodiment will be described with reference to a flowchart shown in FIG. 5.

First, an external apparatus inputs a video signal to the signal input unit 1 of the liquid crystal display device 100 (Step S1).

The timing control unit 3 generates a timing signal on the basis of the video signal and supplies the timing signal to each unit of the liquid crystal display device 100, and the liquid crystal panel 5 is driven in response to the timing signal (Step S2).

Then, the CPU 121 executes the switching program 125*a* to sequentially switch the light emitting units 83*a* to 83*f* to be turned off according to the driving timing of the liquid crystal panel 5 (Step S3).

Then, the CPU 121 determines whether to display all images on the basis of the video signal input in Step S1 (Step S4).

If it is determined that all images are not displayed (Step S4; No), the CPU 121 executes the changing program 125*b*, changes the order in which the light emitting units to be turned off are switched by the execution of the switching program 125*a* (Step S5), and repeatedly performs the process after Step S2.

On the other hand, if it is determined that all images are displayed (Step S4; Yes), the CPU 121 ends the process.

In the liquid crystal display device 100 according to the above-described embodiment, the light emitting units 83*a* to 83*f* include LEDs that are provided at a predetermined interval so as to face the side surface of the light guide plate 81. The light emitting units 83*a* to 83*f* are connected in series to each other, and the feeding circuit 84 includes the switches 85*a* to 85*g* (87*a* to 87*f*) that are connected to both ends 83*aa* to 83*ff* of each of the light emitting units 83*a* to 83*f* and/or both ends 83*aa* to 83*ff* of a plurality of light emitting units 83*a* to 83*f*. When the switches are turned on, the supply of power to the light emitting units 83*a* to 83*f* connected between both ends 83*aa* to 83*ff* stops. The on/off states of each of the switches 85*a* to 85*g* are controlled by the switching program 125*a* according to the driving timing of the liquid crystal panel 5 such that one or a plurality of light emitting units 83*a* to 83*f* to be turned off are sequentially switched.

That is, according to this embodiment of the invention, the CPU 121 executes the switching program 125*a* to control only the on/off states of the switches 85*a* to 85*g* according to the driving timing of the liquid crystal panel 5, without controlling the amount of current or a voltage applied to each of the light emitting units 83*a* to 83*f*, thereby sequentially switching the light emitting units to be turned off (LEDs to be turned off).

Therefore, according to this embodiment of the invention, it is possible to provide a liquid crystal display device capable of easily switching the elements to be turned on or off according to the driving timing of a liquid crystal panel.

In addition, the CPU 121 executes the changing program 125*b* to change the order in which the light emitting units to be turned off are switched by the execution of the switching program 125*a*.

That is, when the light emitting units to be turned off are switched in the same order at each driving timing of the liquid crystal panel 5, the user is likely to perceive a variation in brightness on the display screen during switching. Therefore, the CPU 121 executes the changing program 125*b* to change the order in which the light emitting units 83*a* to 83*f* are switched according to the driving timing of the liquid crystal panel 5. In this way, the user does not perceive the variation in brightness.

The light emitting units 83*a* to 83*f* include a plurality of LEDs connected in series, in parallel, or in series-parallel to each other.

That is, for example, when the amount of light emitted from the backlight to the liquid crystal panel 5 is insufficient or when it is necessary to increase the life span of each LED arranged in the light emitting units 83*a* to 83*f*, it is necessary to arrange a plurality of LEDs in series, in parallel, or in series-parallel to each other according to the circumstances.

The scope of the invention is not limited to the embodiments described above. The scope of the invention is not limited to the embodiments shown in the accompanying drawings. Various modifications and changes of the invention can be made without departing from the scope and spirit of the invention.

What is claimed is:

1. A liquid crystal display device, comprising:

a liquid crystal panel on which an image based on a video signal is displayed;

a light guide plate disposed behind the liquid crystal panel;

a plurality of light emitting units including a plurality of light emitting elements configured to emit light toward the liquid crystal panel through the light guide plate, the light emitting units arranged in series at an interval in such a direction that the light emitting elements face a side surface of the light guide plate;

a feeding circuit configured to supply power to the light emitting units, the feeding circuit including:

a first switch which is connected to both ends of at least one of the light emitting units, wherein the at least one of the light emitting units connected between the both ends is deactivated when the first switch is turned on; and a second switch which is connected to both ends of at least one of the light emitting units, wherein the at least one of the light emitting units connected between the both ends is deactivated when the second switch is turned on; and a switching unit configured to control an on/off state of each of the first and second switches according to a driving timing of the liquid crystal panel to subsequently switch the light emitting units to be deactivated;

a changing unit configured to change an order in which the switching unit switches the light emitting units to be deactivated; and a control unit including a CPU and a storage unit, wherein the storage unit stores a switching program and a changing program;

the CPU is configured to execute the switching program to serve as the switching unit that controls the on/off state of each of the first and second switches according to the driving timing of the liquid crystal panel to sequentially switch the light emitting units to be deactivated;

the CPU is configured to execute the changing program to serve as the changing unit that changes the order in which the light emitting units to be deactivated are sequentially switched; and an order in which a write operation is performed to lines of the liquid crystal panel is changed according to a change of an order in which the light emitting units are sequentially switched.

2. The liquid crystal display device as set forth in claim 1, wherein each of the light emitting units includes a plurality of light emitting elements arranged in series, in parallel, or in series-parallel combination.

* * * * *